US008527193B1

(12) United States Patent
Brennan et al.

(10) Patent No.: US 8,527,193 B1
(45) Date of Patent: Sep. 3, 2013

(54) METHOD FOR DETERMINING RELATIVE MOTION USING ACCELEROMETER DATA

(75) Inventors: Edward M. Brennan, Wenonah, NJ (US); Carl V. Jannetti, Huntingdon Valley, PA (US); John B. Stetson, New Hope, PA (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 13/617,204

(22) Filed: Sep. 14, 2012

Related U.S. Application Data

(62) Division of application No. 11/869,283, filed on Oct. 9, 2007, now Pat. No. 8,296,053.

(51) Int. Cl.

| | |
|---|---|
| ***G05D 1/02*** | (2006.01) |
| ***B63G 1/00*** | (2006.01) |
| ***G01S 13/00*** | (2006.01) |
| ***F41G 7/00*** | (2006.01) |
| ***G01P 15/00*** | (2006.01) |

(52) U.S. Cl.
USPC ..... 701/300; 114/1; 342/26 C; 244/3.21; 73/514.01

(58) Field of Classification Search
USPC ..... 701/300, 480, 479, 509–514, 518, 701/535–536; 310/329; 73/514.01, 488; 333/167; 455/213, 307; 708/300; 342/26, 342/41, 46, 62, 26 C; 244/3.21, 3.28, 125; 114/1, 271
See application file for complete search history.

(56) References Cited

U.S. PATENT DOCUMENTS

| | | | | |
|---|---|---|---|---|
| 4,541,323 | A | 9/1985 | Sadler et al. | |
| 4,589,610 | A * | 5/1986 | Schmidt | 244/3.19 |
| 4,616,127 | A | 10/1986 | Whiting | |
| 5,038,618 | A | 8/1991 | Malvern | |
| 5,072,389 | A * | 12/1991 | Wernli et al. | 89/41.14 |

(Continued)

FOREIGN PATENT DOCUMENTS

| | | |
|---|---|---|
| JP | 09-189564 | * 7/1997 |
| JP | 09189564 | 7/1997 |

OTHER PUBLICATIONS

D.J. Schmidt & G.A. Bendor, Quaternion Matching in Transfer Alignment for SAR Motion Compensation, Westinghouse Electric Corporation, Baltimore, Maryland, CH1449-8/79/0000-0600500.75 copyright 1979 IEEE.

Dr. Thomas Kennedy, The Design of SAR Motion Compensation Systems Incorporating Strapdown Inertial Measurement Units, Los Angeles, CA 90009, 88CH 2572-6/88/0000-0074 1998 IEEE.

(Continued)

*Primary Examiner* — Muhammad Shafi
(74) *Attorney, Agent, or Firm* — Howard IP Law Group, PC

(57) ABSTRACT

A method is disclosed for determining relative motion between equipment systems positioned on a structure that is subject to deformation due to vibrations, using accelerometers. Relative motion between equipment systems can introduce error into the targeting information provided to a system such as a weapons system, and thus the method facilitates compensation for such relative motion. A method is disclosed in which the raw accelerometer signals are filtered, then combined with attitude signals in a displacement calculation module (DCM). Within the DCM, the signals are manipulated to calculate, for each equipment system, the translational and rotational displacements due to hull modal vibration and the translational and rotational displacements due to force vibration. The sum of these values represent the movement of each of the affected equipment systems. Relative motion between systems is calculated as the difference between the calculated movement values.

12 Claims, 6 Drawing Sheets

(56) References Cited

U.S. PATENT DOCUMENTS

| | | | | |
|---|---|---|---|---|
| 6,408,087 | B1 * | 6/2002 | Kramer | 382/124 |
| 6,701,260 | B1 | 3/2004 | Rouvari | |
| 2002/0044014 | A1 * | 4/2002 | Wright et al. | 330/2 |
| 2003/0139826 | A1 * | 7/2003 | Yasui et al. | 700/31 |
| 2005/0256613 | A1 * | 11/2005 | Zuo et al. | 700/280 |
| 2009/0071143 | A1 * | 3/2009 | Foster et al. | 60/445 |

OTHER PUBLICATIONS

I.Y. Bar-Itzhack and Y. Vitek, False Bias Detection in Strapdown INS During In-Flight Transfer Alignment, Haifa, 32000, Israel, Released to AIAA to publish in all forms; 84-1821.

Dr. In Soo Ahn; Mr. Ray Breslau; Dr. Jim Sennott, Tracking & Imaging Systems, Inc., Development and Evaluation of a Precision Coordinate Transfer System for SRGPS.

* cited by examiner

METHOD FOR DETERMINING RELATIVE MOTION USING ACCELEROMETER DATA

CROSS-REFERENCE TO RELATED APPLICATION

This application is a divisional of U.S. patent application Ser. No. 11/869,283, filed Oct. 9, 2007 now U.S. Pat. No. 8,296,053, issued on Jun. 7, 2012 by Edward M. Brennan et al., titled "System and Method for Determining Relative Motion Between Ship Combat System Elements", the entirety of which application is incorporated herein by reference.

GOVERNMENT LICENSE RIGHTS

This invention was made with Government support under contract number N00024-03-C-6110 awarded by the Department of the Navy. The Government has certain rights in this invention.

FIELD OF THE INVENTION

The invention relates to systems and methods for determining relative motion between bodies, and more particularly to systems and methods for compensating for relative motion between ship combat system elements.

BACKGROUND OF THE INVENTION

Ship hull structures deform during at-sea operations due to vibration and wave interaction. Such deformations result in relative motion between combat system elements such as radar systems, inertial navigation system (INS) sensors, and weapons systems. Since these combat system elements are often located on different parts of the ship, relative motion between them can introduce error into the targeting information provided to the weapons systems. Current Aegis combat systems do not compensate for this relative motion because the errors are deemed to be tolerable. It is expected that future combat systems, such as future Aegis Ballistic Missile Defense (BMD) baselines and CG(X), will need to compensate for relative motion between the primary radar and the INS sensors. This is because it is expected that future BMD and CG(X) will have tighter weapons system accuracy requirements, which will require relative motion compensation to meet those requirements.

Motion compensation systems are known. For example, U.S. Pat. No. 5,072,389 to Wernli et al. describes a method for compensating alignment errors in modular marine fire-control systems. The Wernli method involves the direct measurement of rotational speeds and linear accelerations at various system components to determine stabilization data for the associated equipment units. One problem with the Wernli system is that it requires the use of gyroscopes to measure rotational speeds. Such gyroscopes are expensive and require complex isolation systems to meet Navy shock requirements, resulting in substantial acquisition and maintenance costs. Thus, there is a need for a highly reliable and easy to maintain system to compensate for relative motion between combat system elements.

SUMMARY OF THE INVENTION

A system for determining relative motion between combat system elements on a ship having a hull is disclosed, comprising: first and second accelerometers associated with first and second combat system elements, respectively for generating first and second acceleration signals; first and second filter modules coupled to said first and second accelerometers for receiving and conditioning said first and second acceleration signals, respectively for thereby generating conditioned accelerometer signals; and first and second displacement control modules coupled to said first and second filter modules for receiving said conditioned accelerometer signals from said first and second filter modules, respectively, and first and second ship attitude signals, and generating first and second signals representative of rotational and translational displacements of said combat system elements and calculating relative motion between the first and second combat system elements. The first and second displacement control modules may be configured to: (a) determine the translational and rotational displacements of the first and second combat system elements due to hull modal vibration at times $T_1$ and $T_2$; (b) determine the translational and rotational displacements of the first and second combat system elements due to forced vibration at times $T_1$ and $T_2$; and (c) determine relative motion between the first and second combat system elements by differencing the translational and rotational displacements at each of the first and second combat system elements at times $T_1$ and $T_2$.

A method for determining motion between first and second combat system elements on a ship is disclosed, comprising: providing first and second accelerometers associated with first and second combat system elements, respectively for generating first and second acceleration signals; conditioning said first and second acceleration signals; generating first and second signals representative of rotational and translational displacements of said combat system elements based on said conditioned first and second acceleration signals, and first and second ship attitude signals; determining the translational and rotational displacements of the first and second combat system elements due to hull modal vibration at times $T_1$ and $T_2$; determining the translational and rotational displacements of the first and second combat system elements due to forced vibration at times $T_1$ and $T_2$; and determining relative motion between the first and second combat system elements by differencing the translational and rotational displacements at each of the first and second combat system elements at times $T_1$ and $T_2$.

A machine readable storage device tangibly embodying a series of instructions executable by the machine to perform a series of steps is disclosed, the steps comprising: directing first and second signals from first and second accelerometers to first and second filter modules, said first and second accelerometers associated with first and second combat system elements, respectively; conditioning said signals produced by the first and second accelerometers; generating first and second signals representative of rotational and translational displacements of said combat system elements based on said conditioned input signals and first and second ship attitude signals; determining the translational and rotational displacements of the first and second combat system elements due to hull modal vibration at times $T_1$ and $T_2$; determining the translational and rotational displacements of the first and second combat system elements due to forced vibration at times $T_1$ and $T_2$; and determining relative motion between the first and second combat system elements by differencing the translational and rotational displacements at each of the first and second combat system elements at times $T_1$ and $T_2$.

BRIEF DESCRIPTION OF THE DRAWINGS

These and other features and advantages of the present invention will be more fully disclosed in, or rendered obvious by, the following detailed description of the preferred embodiments of the invention, which are to be considered together with the accompanying drawings wherein like numbers refer to like parts and further wherein.

DETAILED DESCRIPTION

Figure 1:
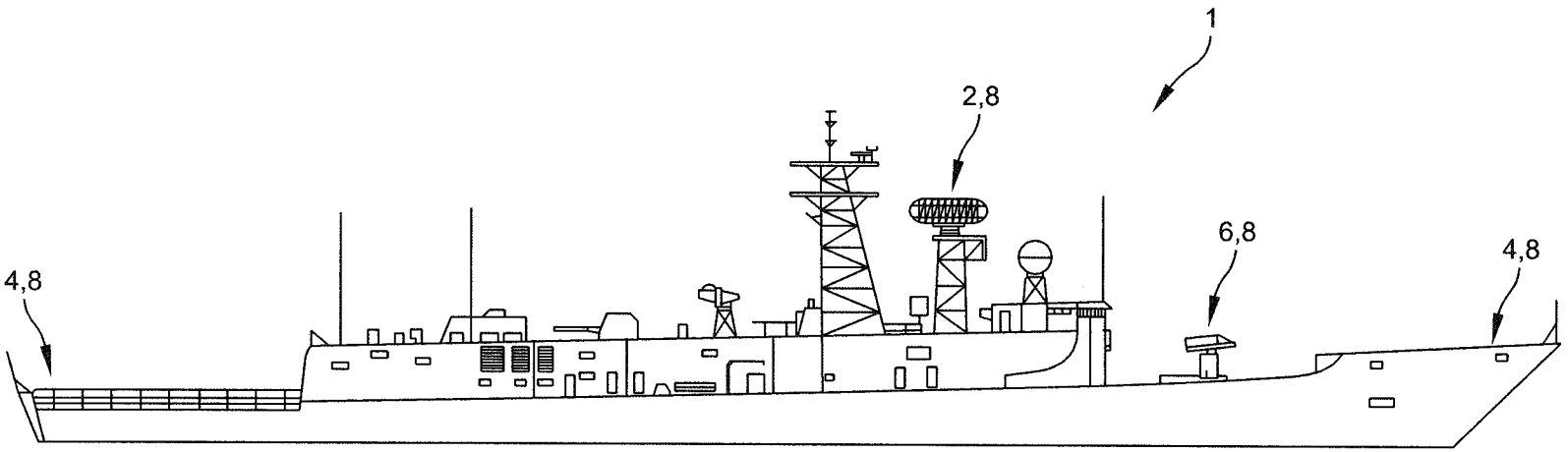
FIG. 1 is a side view of an exemplary ship showing various combat system elements.

The invention is a system and method for determining relative motion between combat system elements positioned on a naval vessel 1, such as that illustrated in FIG. 1. The combat system elements may comprise radar systems 2, forward and aft inertial navigation system (INS) sensors 4, and weapons systems 6. "Relative motion" is described in relation to FIG. 2, in which a pair of combat system elements are labeled "A" and "B." These elements can be any of the aforementioned components (radar, INS sensors, weaponry, etc.) The translational and rotational positions of combat system elements A and B at time $t_1$ may be designated $[A]_1$ and $[B]_1$, while the translational and rotational positions of those same elements at time $T_2$ may be designated $[A]_2$ and $[B]_2$. The positions may be further defined as follows:

$[A]_1=[T_{A1},R_{A1}]$, where:

$T_{A1}=[t_{ax1},t_{ay1},t_{az1}]$ (Translational position)

$R_{A1}=[r_{ax1},r_{ay1},r_{az1}]$ (Rotational position)

Thus defined, the relative motion between combat system elements A and B may be determined as: $([B]_1-[A]_1)-([B]_2-[A]_2)$.

Figure 3:
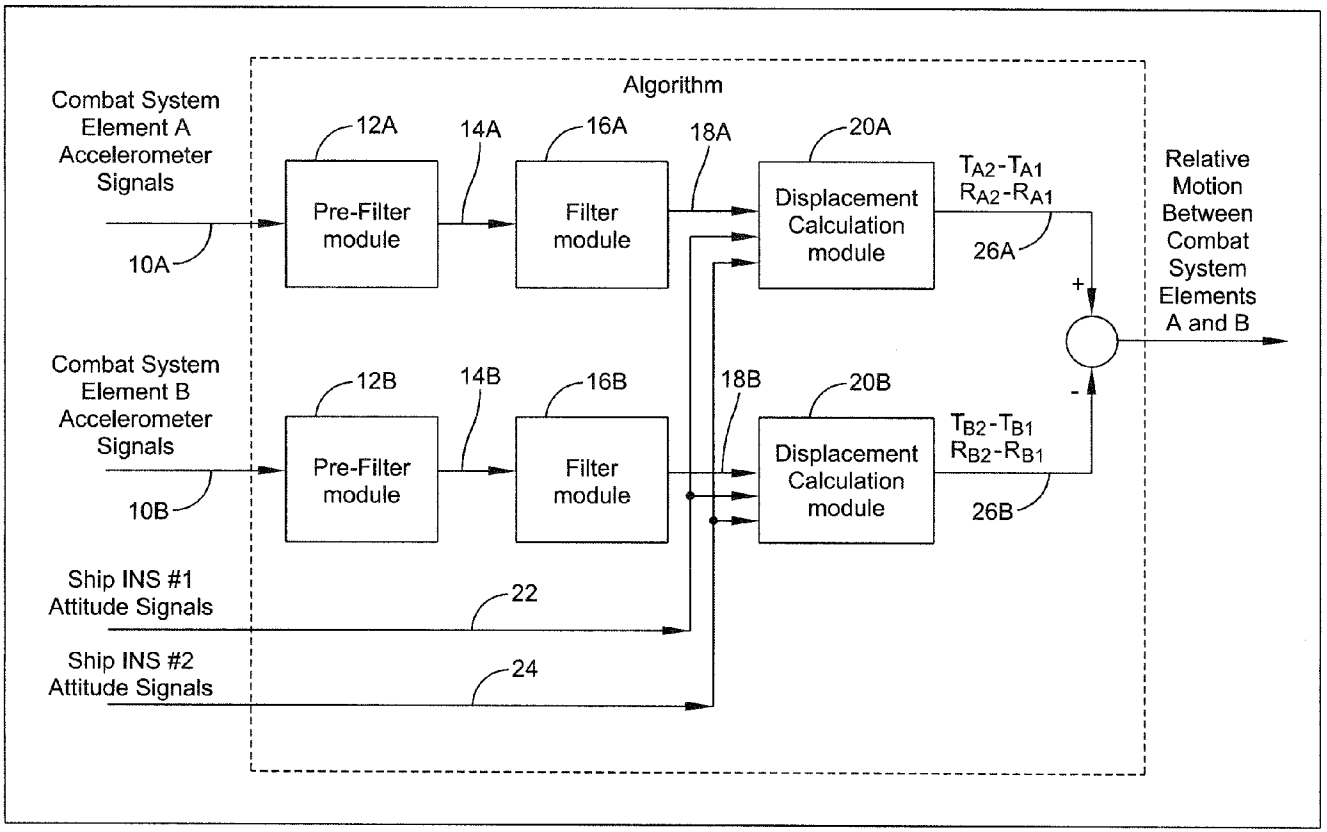
FIG. 3 is a flowchart illustrating an exemplary algorithm in accordance with the invention.

FIG. 3 illustrates an exemplary algorithm for use in calculating the relative motions between elements A and B. As will be appreciated, this algorithm will be a component of the larger system used to compensate for motion between combat system elements. Such a larger system may include accelerometers 8 placed at desired locations on the individual combat system elements, ship INS sensor locations, and other locations on the ship. Examples of such "other locations" would be the main structural bulkheads in the hull and deckhouse superstructure. These locations would be utilized to help determine the deformed hull shapes due to forced and modal vibration. The output from the algorithm will be utilized to correct errors in radar target information due to relative motion.

As shown in FIG. 3, the Algorithm may accept signals from the accelerometers 8 mounted on or adjacent to combat system elements A and B. In this example, elements A and B are a primary radar 2 and weapon system 6 (FIG. 1), though it will be appreciated that the Algorithm may accept signals from accelerometers mounted on any of a variety of ship's structures as previously noted. In addition to the accelerometer signals, the Algorithm may also accept attitude signals from a pair of INS's 4 that are part of the ship's existing equipment. The Algorithm may utilize these signal inputs to determine the relative motion between the combat system elements A, B.

Generally, the signals 10A, B from respective accelerometers 8 connected to elements A and B are sent through respective Pre-Filter Modules 12A, B, which prepare the raw signals for further processing. The pre-filtered signals 14 A, B are then sent through respective Filter Modules 16 A, B to extract those components of the signals necessary for the relative motion calculation. The filtered signals 18 A, B are then sent to respective Displacement Calculation Modules 20 A, B, which combine the filtered accelerometer signal information with ship's attitude signal information 22, 24 provided by the Ship INS's. The output 26A, B from the Displacement Calculation Modules 20 A, B are then differenced to determine resulting values for the relative motion between the combat system elements A, B. This relative motion information will be utilized to correct errors in radar target information due to relative motion.

One advantage of the invention is that it enables relative rotational displacement between elements A and B to be determined using only the respective accelerometers and the ship's existing INS's. In other words, relative rotational displacement between combat system elements can be determined without the need for high-performance angular rate sensors positioned at the combat system elements. Such angular rate sensors are expensive and require complex mechanical isolation systems to meet Navy shock requirements. Thus, the inventive system presents a simplified approach, resulting in enhanced reliability as well as reduced acquisition and maintenance costs.

The individual Modules will now be described in greater detail. For efficiency, the Pre-Filter Module, the Filter Module and the Displacement Calculation Module will be described in relation to combat system element "A" only. It will be appreciated, however, that the description applies equally to the Modules associated with combat system element "B."

Pre-Filter Module

Figure 4:
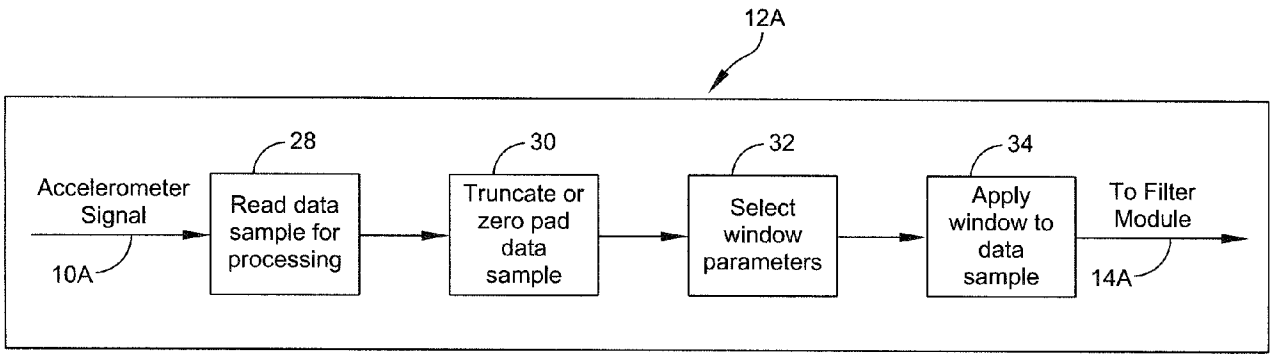
FIG. 4 is a flowchart illustrating exemplary elements of the pre-filter module of the algorithm of FIG. 3.

Referring now to FIG. 4, the Pre-Filter Module 12A will be described in greater detail. As previously noted, the Pre-Filter Module 12A, may be used to prepare the raw signal 10A produced by the accelerometers on or adjacent to individual combat system element A, so that it may be processed further in the Filter Module 16A. Thus, at step 28, an accelerometer data sample is selected for processing. At step 30, the sample is then truncated or zero padded (i.e., zeroes are added to the end of the sample) as necessary to meet the sample length requirements of the Filter Module 16A. The data sample is then smoothed to improve the resolution of the sample data in the frequency domain. This technique is often referred to as "windowing" and it serves to "smooth" the signal to a value of zero at the start and end points of the sample.

Filter Module

Figure 5:
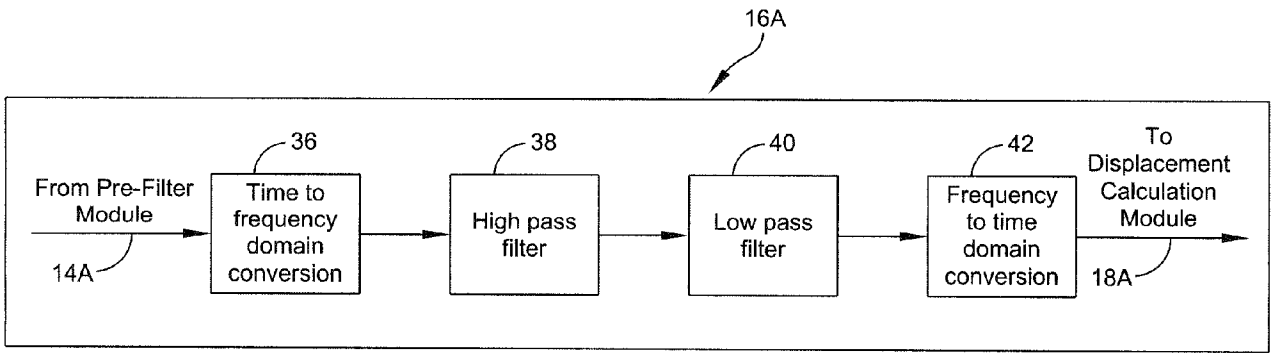
FIG. 5 is a flowchart illustrating exemplary elements of the filter module of the algorithm of FIG. 3.

Referring now to FIG. 5, the Filter Module 16A extract desired components from the signal 14A while leaving unwanted or unnecessary components behind. When accelerometers are placed on ship structures, they produce signals that represent acceleration due to hull vibration as well as ship rigid body motion (i.e., the normal pitch/roll, etc. motion of a ship caused by the forces of the sea). These signals may further contain components of electrical interference.

Hull vibration results in relative motion between combat system elements, but rigid body motion will not. Electrical interference, if not properly identified in the signal, can mistakenly be interpreted as relative motion. Thus, it is desirable to identify and remove those components of the signal attributable to ship rigid body motion and electrical interference, since these components would introduce significant errors into the calculation.

Thus, at step 36 the signal 14A received from the Pre-Filter Module 12A is converted from time to frequency domain, and then directed through appropriate high pass filter 38 and low pass filter 40. Note the high and low pass filters may comprise a band pass filter. At step 42, the signal is converted back from frequency domain to time domain before it is sent on to the Displacement Calculation Module 20A.

Figure 6:
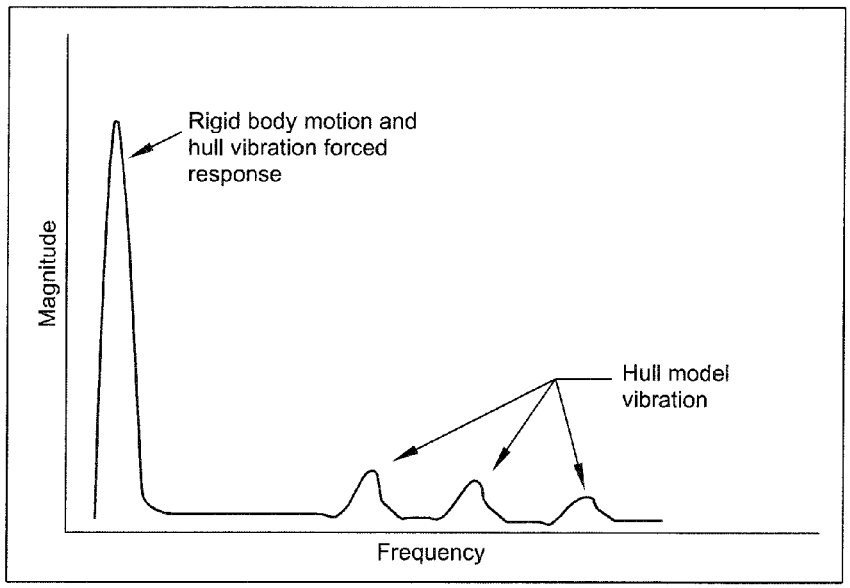
FIG. 6 is an exemplary accelerometer frequency domain representation.

FIG. 6 shows a frequency-domain representation of a typical ship-mounted accelerometer signal. Hull vibration can be categorized as modal vibration and forced response vibration. In the Filter Modules 16A, B, acceleration due to forced response vibration is removed along with acceleration due to rigid body motion because forced response vibration and rigid body motion occur at the same frequency. However, forced response vibration is important because it results in relative motion between combat system elements. Therefore, the displacements due to forced response vibration are estimated in the Displacement Calculation Module 22A, B, as will be described in the next section.

During the filtering process, it is necessary to preserve signal phase because the signals will be mathematically combined by the algorithm to determine relative motion. A slight phase shift in the filtering process can introduce significant errors. Thus, to remove the targeted content while still preserving phase, filtering is performed in the frequency domain using a Fast Fourier Transform (FFT) algorithm. Using an FFT in lieu of a conventional time-domain digital filter also significantly reduces computation time.

The FFT provides a complex signal representation of real and imaginary components. For each frequency, the magnitude is the square root of the sum of the squares of the real and imaginary components. For each frequency, the phase is the inverse tangent of the ratio of imaginary to real component. To extract the desired frequencies, the unwanted frequencies are essentially zeroed out by multiplying their corresponding real and imaginary components by a very small non-zero value. For each frequency, it is important that the real and imaginary components are multiplied by the same small non-zero value as this will keep the imaginary-to-real component ratio constant and preserve phase.

The algorithm also determines filter cut-off frequencies. It is desirable to select cut-off frequencies such that all rigid body motion is removed and all relative motion is retained. The algorithm identifies rigid body motion frequencies and modal vibration frequencies in the FFT signal representation by comparison to predetermined expected rigid body motion and modal vibration frequencies.

Displacement Calculation Module

Figure 7:
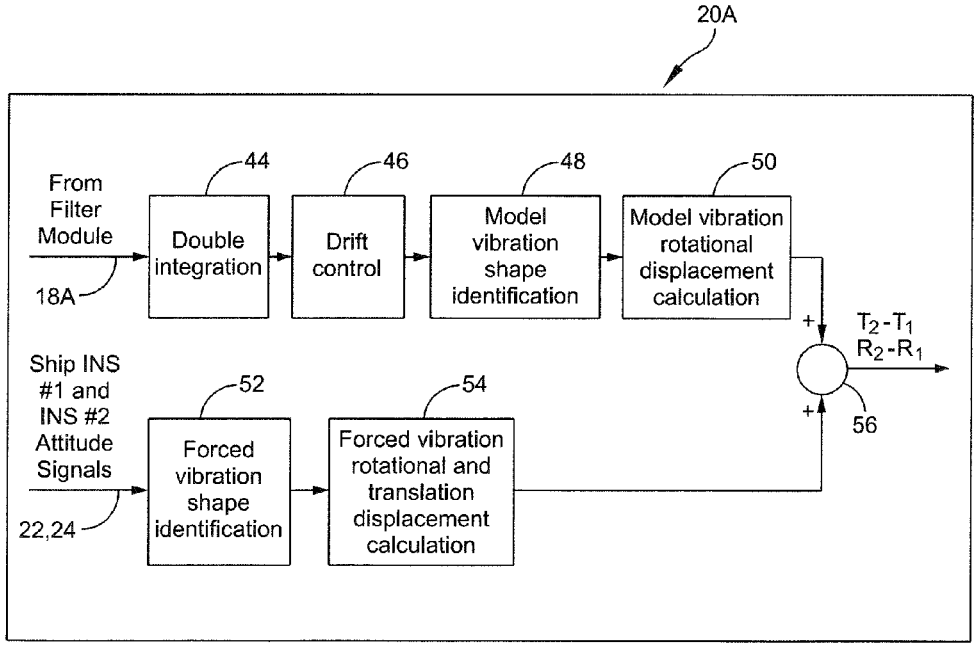
FIG. 7 is a flowchart illustrating exemplary elements of the displacement calculation module of the algorithm of FIG. 3.

Referring now to FIG. 7, Displacement Calculation Module 22A is shown. The Displacement Calculation Module 22A calculates the rotational and translational displacement of the associated combat system element A.

As can be seen, the filtered accelerometer signal 18A is received from the filter module, and at step 44, the translational displacement due to hull modal vibration is calculated by double integrating the signals. In order to obtain meaningful results, the algorithm must employ a mechanism to limit or eliminate the drift associated with the numerical integration operation. This obstacle is dealt with using a digital finite-impulse response (FIR) filter at step 46 in a manner that does not impact the signal's phase angle. Although the filter attenuates the signal, it also modifies the phase angle of the signal over a very wide frequency domain, including the frequencies corresponding to the hull modes. This phase angle distortion can impart a very large error in relative displacement calculations and must be minimized. The chosen solution is to reverse the FIR-filtered data in time, i.e. begin with the maximum time and end at time zero, and pass the signal through the FIR filter a second time. The end result is a FIR filter that applies the square of the gain of the original filter, but does not impact the signal's phase angle.

Figure 8:
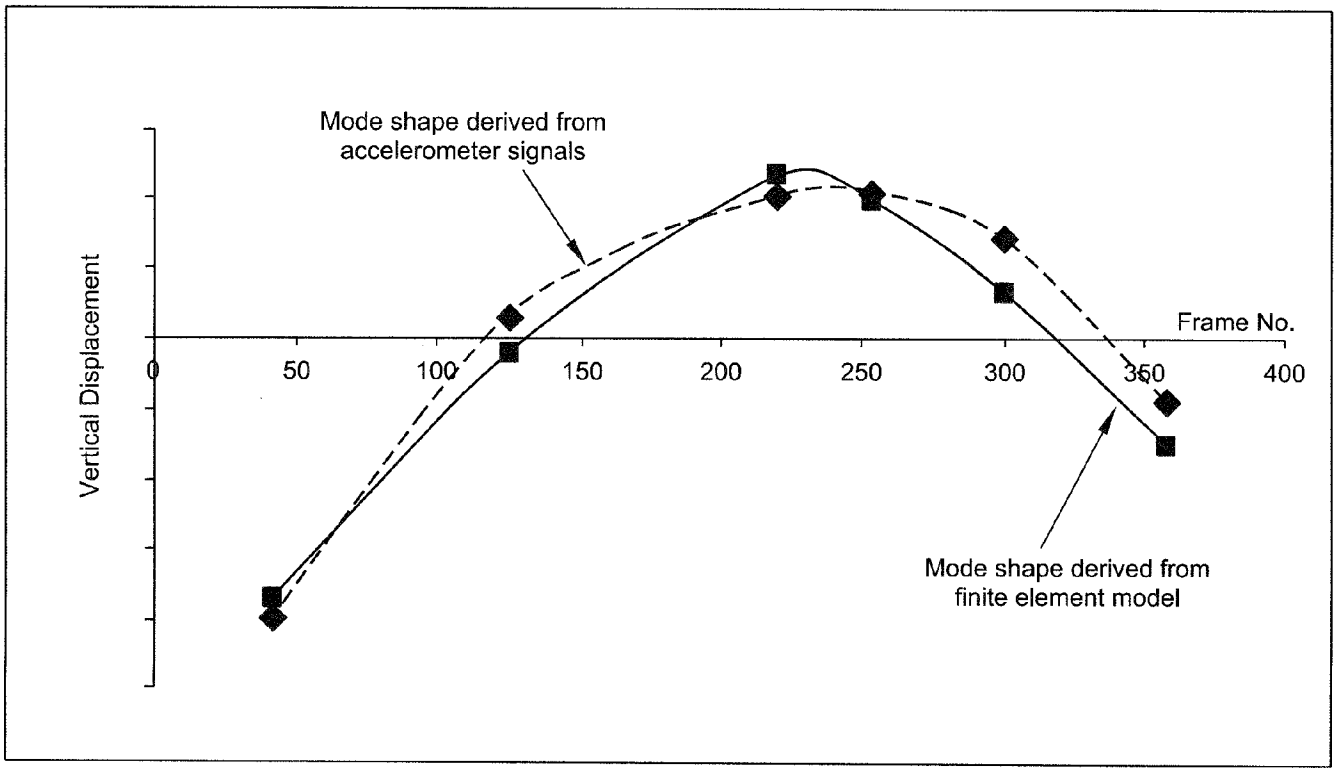
FIG. 8 is a graphical example of fitting a pre-determined mode shape derived from a ship structural finite element model with a mode shape derived from filtered accelerometer signals.

Next, at steps 48 and 50, the rotational displacement due to hull modal vibration is calculated. The first three hull vibration modes are identified (step 48) by analyzing the filtered accelerometer signals in the frequency domain. A mode shape factor for each of the three modes is then calculated by fitting a pre-determined mode shape derived from a ship structural finite element model with a mode shape derived from the filtered accelerometer signals. FIG. 8 shows an example of fitted mode shapes for the first vibration mode. Next, the rotational displacement for each of the first three vibration modes is calculated (step 50) by multiplying the predetermined rotational displacement from the finite element by the mode shape factor. Total rotational displacement is calculated by summing calculated rotational displacements from the first three vibration modes.

Next, the translational and rotational displacements due to forced vibration are calculated. Recall from above that the acceleration due to forced vibration was removed from the accelerometer signals in the Filter Module 16. Therefore, the accelerometer signals are not used in this calculation. Instead, the forward and aft INS attitude signals 22, 24 are used to determine the hull's deflected shape due to forced vibration. The forward and aft attitude signals 22, 24 in three axes are differenced which essentially removes rigid body motion and leaves relative rotation due to forced vibration. Hull bending shapes and magnitudes are then determined at step 52 by comparing the differenced attitude data to forced vibration deflection shapes determined previously from at-sea vibration data collection. Translational and rotational displacements at the combat system elements are then calculated at step 54 using the hull bending shape data.

Figure 2:
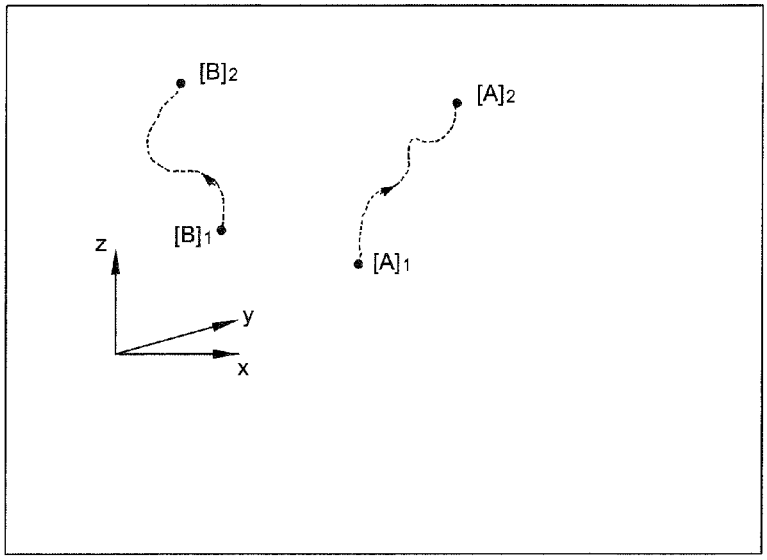
FIG. 2 is a mathematical description of relative motion between combat system elements.

Next, the rotational and translational displacement at each combat system element is calculated at step 56 by summing the rotational/translational displacement due to hull modal vibration and the rotational/translational displacement due to forced vibration. Finally the relative motion between combat system elements is calculated as shown in FIG. 2 by differencing the rotational/translation displacements at each combat system element $[([B]_1-[A]_1)-[B]_2-[A]_2)]$.

This calculated relative motion information may then be utilized to correct errors in radar target information due to relative motion.

The invention described herein may be automated by, for example, tangibly embodying a program of instructions upon a computer readable storage media, capable of being read by machine capable of executing the instructions. A general purpose computer is one example of such a machine. Examples of appropriate storage media are well known in the art and would include such devices as a readable or writeable CD, flash memory chips (e.g., thumb drive), various magnetic storage media, and the like.

The features of the invention have been disclosed, and further variations will be apparent to persons skilled in the art. All such variations are considered to be within the scope of the appended claims. Reference should be made to the appended claims, rather than the foregoing specification, as indicating the true scope of the subject invention.

The invention claimed is:

1. A method for determining motion between first and second equipment systems positioned on a structure that is subject to deformation due to vibrations, comprising:

receiving first and second acceleration signals from first and second accelerometers associated with the first and second equipment systems, respectively, and conditioning using a computer processor said first and second acceleration signals;

receiving first and second ship attitude signals from first and second inertial navigation systems (INS) sensors positioned at different locations on-board the ship;

generating first and second signals representative of rotational and translational displacements of said first and second equipment systems based on said conditioned first and second acceleration signals, and said first and second attitude signals;

determining the translational and rotational displacements of the first and second equipment systems due to modal vibration of the structure at times $T_1$ and $T_2$;

determining the translational and rotational displacements of the first and second equipment systems due to forced vibration at times $T_1$ and $T_2$ by differencing the first and second INS attitude signals to remove rigid body motion, and comparing the differenced attitude signals to data indicative of predetermined vibration deflection shapes, wherein the determining the rotational displacements of the first and second equipment systems due to modal vibration of the structure at times T1 and T2 comprises determining differences between a) a vibration model associated with the structure and derived from said received accelerometer signals, and b) a predetermined vibration model associated with the structure; and using said differences to calculate rotational displacements for a plurality of vibration modes of the structure; and determining relative motion between the first and second equipment systems by differencing the translational and rotational displacements at each of the first and second equipment systems at times $T_1$ and $T_2$.

2. The method of claim 1, further comprising correcting for errors in one or more of said equipment systems using said determined relative motion between the first and second equipment systems.

3. The method of claim 1, wherein the structure is a ship having a hull deformable during at-sea operations due to vibration and wave interaction.

4. The method of claim 1, wherein said first equipment system is a radar system.

5. The method of claim 4, wherein said second equipment system is a weapon system.

6. The method of claim 1, wherein the conditioning the first and second input signals comprises converting the signal from time to frequency domain, band pass filtering the converted signal; and then converting the filtered signal back from the frequency domain to the time domain.

7. The method of claim 6, wherein the determining the translational displacements of the first and second equipments systems due to modal vibration of the structure at times $T_1$ and $T_2$ comprise double-integrating the first and second signals and eliminating the drift associated with the double-integration process using a digital finite-impulse response (FIR) filter.

8. A method for determining motion between first and second combat system elements on a ship, comprising:

providing first and second accelerometers associated with first and second combat system elements, respectively for generating first and second acceleration signals;

providing first and second inertial navigation systems (INS) sensors positioned at different locations on-board the ship for generating first and second ship attitude signals;

conditioning using a computer processor said first and second acceleration signals;

generating first and second signals representative of rotational and translational displacements of said combat system elements based on said conditioned first and second acceleration signals, and first and second ship attitude signals;

determining the translational and rotational displacements of the first and second combat system elements due to hull modal vibration at times $T_1$ and $T_2$;

determining the translational and rotational displacements of the first and second combat system elements due to forced vibration at times $T_1$ and $T_2$ by differencing the first and second INS attitude signals to remove rigid body motion, and comparing the differenced attitude signals to forced vibration deflection shapes determined previously from at-sea vibration data collection, wherein the rotational displacements of the first and second combat system elements due to hull modal vibration at times T1 and T2 are determined by analyzing the filtered accelerometer signals in the frequency domain to identify the first three ship's hull vibration mode frequencies, calculating a contribution factor for each of the three modes based on the fast-Fourier transform (FFT) magnitude of the signal, and calculating the rotational displacements using mode shapes derived from a hull finite element model and the calculated mode shape contribution factors; and determining relative motion between the first and second combat system elements by differencing the translational and rotational displacements at each of the first and second combat system elements at times $T_1$ and $T_2$.

9. The method of claim 8, wherein the step of conditioning the first and second input signals comprises removing components of the signal due to rigid body motion, and due to electrical interference.

10. The method of claim 9, wherein the step of conditioning the first and second input signals further comprises smoothing the raw accelerometer signal, converting the signal from time to frequency domain, directing the signal through a band pass filter, and then converting the signal back from frequency domain to time domain.

11. The method of claim 10, wherein the translational displacements of the first and second combat system elements due to hull modal vibration at times $T_1$ and $T_2$ are determined by double-integrating the first and second signals and eliminating the drift associated with the double-integration process using a digital finite-impulse response (FIR) filter.

12. The method of claim 8, wherein the first and second combat system elements comprise a primary radar and a weapons launcher.

* * * * *